United States Patent [19]

Wampler

[11] Patent Number: 4,494,753

[45] Date of Patent: Jan. 22, 1985

[54] THREE-DIMENSIONAL TOY MAZE

[76] Inventor: George S. Wampler, 1701 S. Ditmar St., Oceanside, Calif. 92054

[21] Appl. No.: 497,605

[22] Filed: May 24, 1983

[51] Int. Cl.[3] ..... H63F 7/04

[52] U.S. Cl. ..... 273/113; 273/128 A

[58] Field of Search ..... 273/109, 113, 116, 120 R; 46/43

[56] References Cited

U.S. PATENT DOCUMENTS

| | | | |
|---|---|---|---|
| 2,261,804 | 11/1941 | Hall | 273/113 |
| 2,509,340 | 5/1950 | Fly | 273/109 |
| 2,873,119 | 2/1959 | O'Rourke | 273/120 R X |
| 3,075,770 | 1/1963 | Young | 273/109 |
| 3,406,971 | 10/1968 | Koff | 273/109 |
| 3,989,255 | 11/1976 | Raffa | 273/109 X |
| 4,005,865 | 2/1977 | Kidder | 273/109 |
| 4,008,895 | 2/1977 | Reiner et al. | 273/113 |

FOREIGN PATENT DOCUMENTS

| | | | |
|---|---|---|---|
| 1146275 | 11/1957 | France | 273/109 |
| 752110 | 7/1956 | United Kingdom | 273/113 |
| 1098452 | 1/1968 | United Kingdom | 273/109 |
| 2113106 | 8/1983 | United Kingdom | 273/113 |

OTHER PUBLICATIONS

"Try It", Playthings Magazine, p. 8, Aug., 1961.

*Primary Examiner*—Richard C. Pinkham
*Assistant Examiner*—Scott L. Brown
*Attorney, Agent, or Firm*—John J. Murphey

[57] ABSTRACT

A transparent enclosed cube containing a maze constructed of a plurality of layers of parallel square tubes separated by other layers of parallel square tubes, each tube having at least one opening to a neighboring tube, entrance opening to insert a ball therein that will traverse the maze to an exit opening by gravity when the cube is manipulated about its three axes. The ball may be made with a resilient surface and the entrance opening may be smaller than the other tube openings so the ball must be squeezed through the entrance.

11 Claims, 3 Drawing Figures

THREE-DIMENSIONAL TOY MAZE

BRIEF SUMMARY OF THE INVENTION

A three-dimensional transparent toy in the form of an enclosed cube with a three-dimensional maze constructed therein of layers of square tubes in alternate perpendicular array and at least one aperture in each tube through to a neighboring tube, an entrance aperture and exit aperture in different cube sides and a small ball for insertion into the entrance aperture and for traversing the maze under gravity when the toy is manipulated about the three-dimensional axes.

An object of this invention is to provide a rather complicated visual aid and competitive toy to teach users the cooperative effects of gravity and spatial position about a three-dimensional axis system. Another object of this invention is to provide a three-dimensional maze of simplistic construction for use by persons of all ages. A still further object of this invention is a device for cultivating an enhanced appreciation of three-dimensional motion interaction on a friendly and yet slightly competitive basis. And still another object of this invention is to provide a safe and convenient means of improving hand-eye coordination in young and old persons alike.

DETAILED DESCRIPTION

Figure 1:
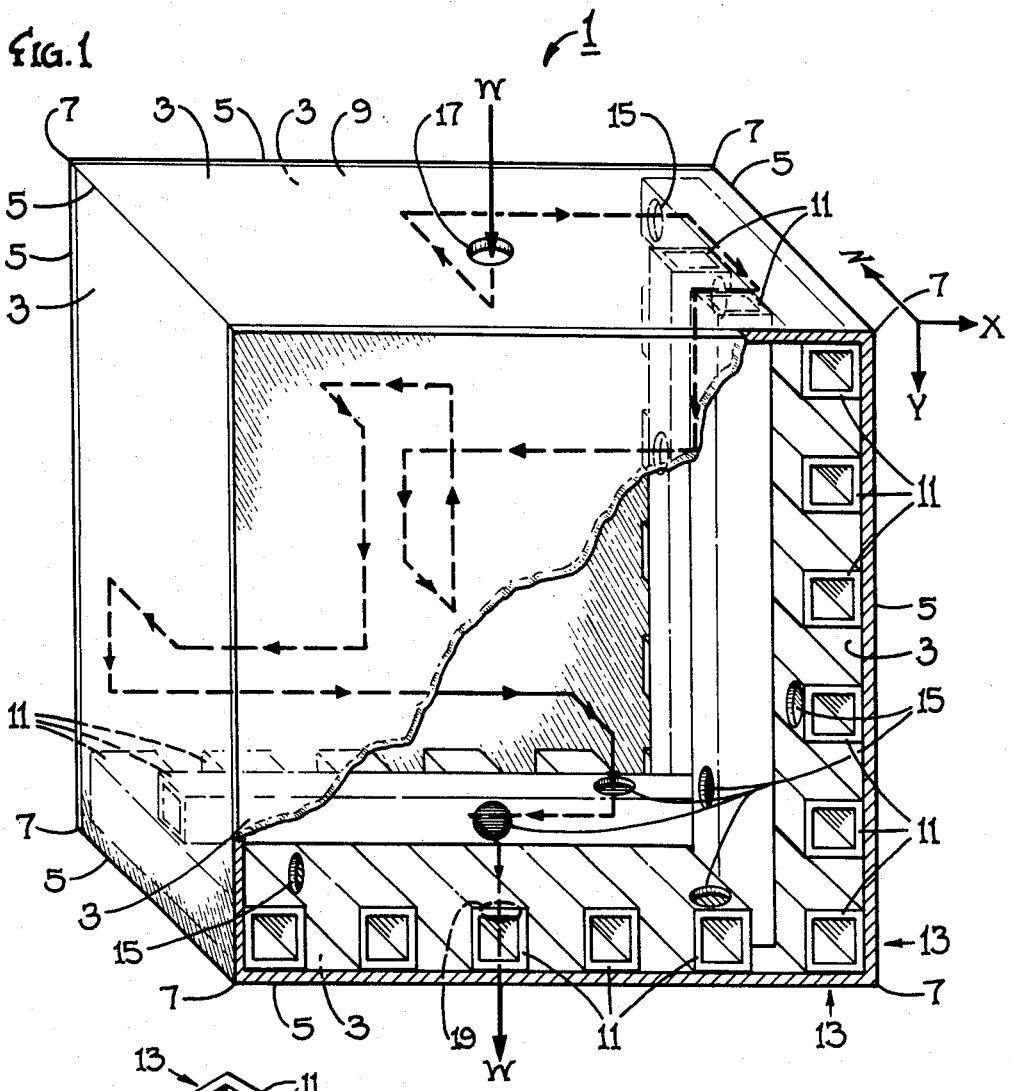
FIG. 1 is an oblique view of the preferred embodiment of this invention with one panel partially broken away to show the interior thereof.

FIG. 1 shows the preferred embodiment of this invention beginning with hand-holdable object 1, which is constructed along three principal axes, x, y and z and includes panels or sides 3, each having four edges 5 and right angled corners 7.

In this preferred embodiment, panels 3 are all square, of equal size and are connected together along edges 5 by any conventional means such as glue, tape or a combination thereof, to form an enclosed cube 9. In other embodiments contemplated within the scope of this invention, panels 3 may be of different size as long as corners 7 are all right angled so that they can be joined at their respective edges and corners to form a three-dimensional totally enclosed object such as a cuboid which may be short in height (along the x axis), narrow in width (along the y axis) or shallow in depth (along the z axis).

Inside cube 9 are hollow tubes 11 arranged in layers 13 that lie parallel to at least two panels 3 that bound opposite sides of cube 9. In each layer 13 tubes 11 are parallel to each other and perpendicular to the tubes in the layers immediately above and below them. Tubes 11 are also parallel to at least four panels 3 and perpendicularly abut the other two panels. This alignment of tubes 11 parallel within each layer and parallel with other tubes in every other layer is termed a "mutually parallel fixed array of tubes" for clarity.

Figure 2:
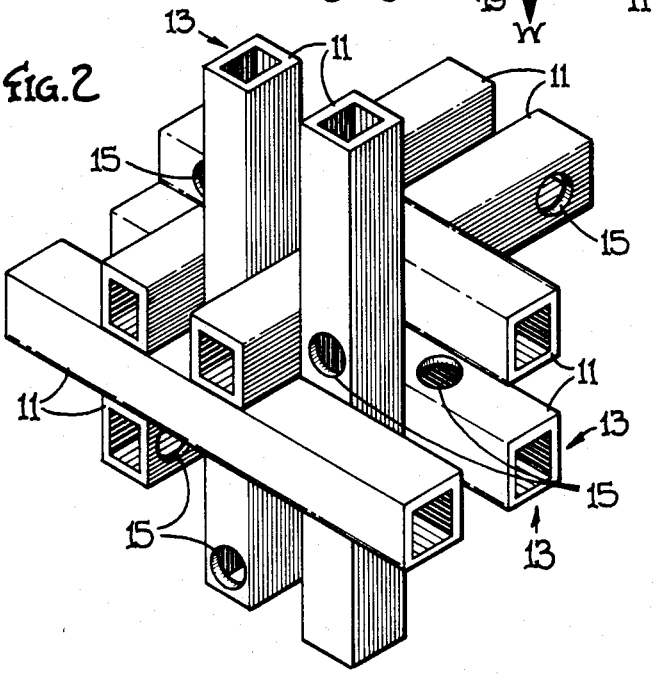
FIG. 2 is an isometric view of an array of some of the tubes as they are positioned inside the toy.

As shown in FIG. 2, each tube 11 is separated from its neighbor tube 11 in any layer 13 by other tubes 11 mutually perpendicular thereto about the other two axes. This alignment of tubes skewed perpendicular to each neighboring tube is termed a "regular patterned arrangement" for clarity. Tubes 11 are shown in this embodiment to have equal length and square cross-sections of equal height and width, however, other regular polygonal cross-sections are contemplated within the scope of this invention such as pentagons, hexagons, heptagons, etc., all the way to circular, and different tube lengths are contemplated when object 1 is changed from a cube to cuboid.

Cube sides or panels 3 and tubes 11 are either to be transparent to light or translucent, the reason being that best results are achieved when the user is able to view his or her progress in handling the toy. Panels 3 and tubes 11 can be of different translucency i.e., diaphanous in overall character and the toy will remain operative; the preferred embodiment however is that they both be transparent. Panels 3 and tubes 11 may be constructed of any diaphanous material such as glass, polycarbonate, Lexan®, Lucite®, and the like.

Each tube 11 has at least one aperture 15 form in the wall thereof somewhere along its length, in a random fashion or manner, into a next adjacent (non-parallel) tube 11 of sufficient size to permit passage of a ball or sphere therethrough from the one tube to the other. Thus is formed a three-dimensional maze within object 1. Many, but not necessarily all, tubes have more than one such aperture 15 to form a confusing network of interconnected paths with a few blind alleys or dead ends within the tubes which is the main characteristic of a maze.

An entrance aperture 17 is formed in one of said panels 3 in communication with the nearest tube 11 thereto. Although aperture 17 may be placed anywhere on panel 3, it is preferred to have it located near the geometric center of the panel for a balanced appearance. An exit aperture 19 is formed on another of said panels 3, preferrably central on the panel, and preferrably on the panel opposite the panel containing entrance aperture 17, in communication with the tube 11 nearest it. For best results, the random locations of apertures 15, between tubes 11, form only a few unobstructed paths between entrance aperture 17 and exit aperture 19 along with numerous "blind alleys" and "switchbacks." One such unobstructed maze path is schematically indicated at W-W in FIG. 1 with dotted line and direction arrows.

A small round ball 21 is introduced into entrance aperture 17 and then object 1 is manipulated about its three axes, x, y and z, in an effort to make ball 21 traverse the three-dimensional maze by gravity to exit aperture 19.

Figure 3:
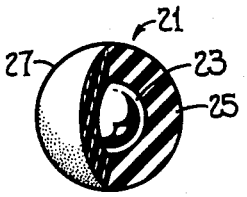
FIG. 3 is a partial sectional view of one embodiment of the ball used with the toy.

For even more enjoyment and competitive spirit, entrance aperture 17 is formed smaller than both intertube apertures 15 and exit aperture 19. A small heavy metal pill 23 is encapsulated in a resilient covering 25, and shaped into sphere 27 (see FIG. 3). Sphere 27 is then squeezed through slightly smaller entrance aperture 17 so that it cannot come back out under its own power but can only be removed through exit aperture 19 after traversing the whole maze.

What is claimed is:

1. A hand-held toy comprising:

(a) a three-dimensional, six-sided totally enclosed diaphanous object containing a plurality of layers of hollow tubes of equal internal height and width in mutually parallel fixed arrangement;

(1) each said tube in each said layer separated from its neighbor parallel tube by another tube mutually perpendicular thereto;

(2) each said tube having at least one aperture formed in the wall thereof at random locations for passage of a sphere of fixed size therethrough into an adjacent tube to form a three-dimensional maze;

(3) an entrance aperture, formed in one side of said object and in communication with at least one said tube, (4) an exit aperture, formed in another side of said object in communication with at least one said tube, a size at least equal to said tube apertures; and, (b) a play ball for passage in through said entrance aperture to the maze and for travel through said maze by gravity when said toy is manipulated about its three axes to exit said maze through said exit aperture.

2. The toy of claim 1 wherein said three-dimensional object is cuboid in shape.

3. The toy of claim 1 wherein said three-dimensional object is a cube.

4. The toy of claim 1 wherein said toy is translucent.

5. The toy of claim 1 wherein said toy is transparent.

6. The toy of claim 1 wherein said hollow tubes have a square cross-section.

7. The toy of claim 1 wherein each said tube has at least two apertures formed therein in the walls thereof at random locations therealong for passage of said sphere of fixed size therethrough into an adjacent tube.

8. The toy of claim 1 wherein said entrance aperture and said exit aperture are on opposite sides of said three dimensional object.

9. The toy of claim 1 wherein said entrance aperture and said exit aperture are of equal size.

10. The toy of claim 1 wherein said entrance aperture is of a smaller size than said tube apertures and said play ball is a metal sphere having a resilient coating covering the surface thereof so that squeezing said coating allows said sphere to pass through said entrance aperture.

11. A three-dimensional hand-held toy comprising:

(a) six equal square transparent panels connected together along their respective edges to form an enclosed cube containing a plurality of layers of transparent, hollow, square cross-sectional tubes each of equal length, height and width arranged in a mutually parallel fixed array wherein all said tubes in any said layer abut a pair of opposite cube sides;

(1) each said tube separated from its neighbor parallel tube by another tube mutually perpendicular thereto to form a regular patterned arrangement about said tube's three dimensional axes;

(2) each said tube having at least one aperture formed in the wall thereof at random locations for passage of a sphere of fixed size into an adjacent non-parallel tube to form a three-dimensional maze;

(3) an entrance aperture formed in one of said cube surfaces in communication with at least one said tube, of smaller size than said tube apertures;

(4) an exit aperture formed in the opposite cube surface in communication with at least one said tube and of a size at least equal to said tube apertures; and, (b) a play sphere having a resilient surface for squeezable passage in through said entrance aperture to the maze and for travel through the maze by gravity when said toy is manipulated about its three axes and to exit said maze through said exit aperture.

* * * * *